US007107679B2

(12) United States Patent
Arai et al.

(10) Patent No.: US 7,107,679 B2
(45) **Date of Patent: *Sep. 19, 2006**

(54) FORMING METHOD OF THROTTLE APPARATUS FOR INTERNAL COMBUSTION ENGINE

(75) Inventors: Tsuyoshi Arai, Kariya (JP); Naoki Hiraiwa, Toyokawa (JP); Masami Goto, Kasugai (JP); Katsuya Torii, Anjo (JP)

(73) Assignee: Denso Corporation, (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/983,262

(22) Filed: Nov. 8, 2004

(65) Prior Publication Data

US 2005/0097744 A1 May 12, 2005

(30) Foreign Application Priority Data

Nov. 7, 2003 (JP) ..... 2003-379157

(51) Int. Cl.
*B21K 1/22* (2006.01)
*B21K 1/20* (2006.01)
*B29C 45/00* (2006.01)

(52) U.S. Cl. ..... 29/888.4; 29/888.45; 29/888.46; 29/527.1; 264/242; 264/328.8; 264/334; 425/812

(58) Field of Classification Search ..... 29/888.4, 29/888.45, 888.46, 527.1; 264/242, 328.8, 264/328.18, 334, 275; 425/812
See application file for complete search history.

(56) References Cited

U.S. PATENT DOCUMENTS 3,675,888 A * 7/1972 Scaramucci ..... 249/57
4,995,445 A * 2/1991 Shigyo ..... 164/305
5,304,336 A 4/1994 Karlsson et al.
5,421,718 A * 6/1995 Karlsson et al. ..... 425/577
5,794,591 A * 8/1998 Kalebjian et al. ..... 123/337
6,138,988 A * 10/2000 Bouvet et al. ..... 251/306
6,451,238 B1 * 9/2002 Suzuki et al. ..... 264/250
6,649,111 B1 * 11/2003 Hannewald et al. ..... 264/278
6,764,062 B1 * 7/2004 Daly ..... 251/305
2002/0163106 A1 * 11/2002 Hendry ..... 264/500
2005/0022365 A1 2/2005 Arai et al.
2005/0022781 A1 2/2005 Arai et al.
2005/0022786 A1 2/2005 Arai et al.
2005/0022787 A1 2/2005 Arai et al.
2005/0097743 A1 5/2005 Arai et al.
2005/0097745 A1 5/2005 Arai et al.
2005/0120556 A1 6/2005 Arai et al.

FOREIGN PATENT DOCUMENTS

DE 101 05 526 A1 8/2002
JP 2000-202866 7/2000

* cited by examiner

*Primary Examiner*—David P. Bryant
*Assistant Examiner*—Sarang Afzali
(74) *Attorney, Agent, or Firm*—Nixon & Vanderhye PC

(57) ABSTRACT

A throttle valve and the throttle body are formed substantially simultaneously in the same dies. When a movable die moves away from a fixed die, a body ejector pin, a valve ejector pin, and a motor housing ejector pin simultaneously push a bore wall of the throttle body, a motor housing, and peripheral edge of the throttle the valve in a radial direction respectively. A deformation of the throttle valve can be avoided because a stress concentration on the metal shaft of the throttle valve is reduced in opening the dies.

20 Claims, 6 Drawing Sheets

FORMING METHOD OF THROTTLE APPARATUS FOR INTERNAL COMBUSTION ENGINE

CROSS REFERENCE TO RELATED APPLICATION

This application is based on Japanese Patent Application No. 2003-379157 filed on Nov. 7, 2003, the disclosure of which is incorporated herein by reference.

FIELD OF THE INVENTION

The present invention relates to a forming method of a throttle apparatus for an internal combustion engine mounted in a vehicle. Especially, the present invention relates to an injection molding method of a throttle apparatus, in which a throttle valve and a throttle body are substantially simultaneously formed in the same dies.

BACKGROUND OF THE INVENTION

In an electrically controlled throttle apparatus shown in FIG. 8, a driving device such as a motor controls an opening degree of a throttle valve 102 in accordance with a position of an accelerator pedal stepped by a driver. In the throttle apparatus, a gap is formed between an inner periphery of a substantially tubular throttle body 101 and an outer circumferential periphery of a throttle valve 102, and the gap has a large influence of an air tightness of the throttle apparatus when the throttle valve 102 is in its full close position.

Conventionally, the throttle body 101 and the throttle valve 102 are independently manufactured in each different process. Subsequently, a manufactured throttle valve 102 is combined with a manufactured throttle body 101 in accordance with an inner peripheral dimension of the manufactured throttle body 101 in a downstream process. Alternatively, a manufactured throttle body 101 is combined with a manufactured throttle valve 102 in accordance with an outer circumferential dimension of the throttle valve 102 in a downstream process. Thus, a predetermined gap is obtained between the bore inner periphery of the throttle body 101 and the outer circumferential periphery of a throttle valve 102. A throttle shaft 103 integrally rotates with the throttle valve 102. Both of the ends of the throttle shaft 103 are rotatably supported by cylindrical bearings 104 provided in the throttle body 101.

U.S. Pat. No. 5,304,336, which is a counterpart of JP-5-141540A, shows molding methods in which a manufacturing process of the throttle body and the throttle valve is reduced. In the molding methods, the throttle body 101 and the throttle valve 102 shown in FIG. 9 are integrally molded of a resinous material in the same molding dies. At first, the substantially tubular throttle body 101 is integrally molded of a resinous material. Subsequently, inner periphery (bore inner periphery) of the throttle body 101 is used as a part of a molding die molding the throttle valve 102, and the throttle valve 102 is molded. Thus, a shape of an outer circumferential periphery of the throttle valve 102 is adapted to a shape of the bore inner periphery of the throttle body 101 in the above molding methods.

The throttle body 101 is molded of a resinous material in a body cavity formed in a fixed dies 111, 112 and a moving die 113. The molded throttle body 101 is gradually cooled in the body cavity to be solidified. Subsequently, the movable die 113 is slid forward in order to form a valve cavity, into which a resinous material is filled. The throttle valve 102 is molded of a resinous material in the throttle body 101.

However, in the above molding methods of the throttle valve 102, the throttle body 101 is molded of a resinous material while the molded throttle body 101 is restricted by dies in its radial direction and in its substantially circumferential direction. Thus, the throttle valve 102 is molded of a resinous material while the throttle body 101 and the throttle valve 102 are restricted by the dies. The throttle body 101 and the throttle valve 102 are taken out of the dies, and gradually cooled. In this cooling period, the unrestricted throttle body 101 and the throttle valve 102 are contracted. The throttle body 101 and the throttle valve 102 are deformed. Accordingly, it is difficult to maintain the gap in a predetermined dimension between the inner periphery of the throttle body 101 and the outer circumferential periphery of the throttle valve 102.

A practical use of the throttle apparatus release an internal stress, by which the apparatus is deformed. When the throttle apparatus is made from a crystal resin and is crystallized, the apparatus is deformed due to the crystallization thereof. Even the apparatus is annealed or aged, the throttle body 101 and the throttle valve 102 are deformed individually.

To solve the above problem, the inventors filed Japanese patent application No. 2003-285434 on Aug. 1, 2003. In this application, the throttle valve and throttle body is formed in a same die in such a manner that the throttle valve is opened in a predetermined angle as shown in FIG. 10. However, when the molding is ejected from the die, ejector pins push out the molding to cause a stress concentration on the throttle shaft 103. Such a stress concentration may cause a deformation of the throttle shaft 103.

SUMMARY OF THE INVENTION

An object of the present invention is to provide a forming method of the throttle apparatus in which a predetermined gap is maintained between the inner periphery of the throttle body and the outer periphery of the throttle valve, and in which the deformation of the throttle valve is avoided.

According to the present invention, a forming method of a throttle apparatus for an internal combustion engine is conducted as follows.

At first, clamping molding dies to form a body cavity and a valve cavity therein, the body cavity being for molding a throttle body and the valve cavity being for molding a throttle valve. Next, injecting a filler into the body cavity and the valve cavity. Next, moving a die away from the other die, and protruding a body ejector pin into the body cavity and a valve ejector pin into the valve cavity in order to eject a solidified molding.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

Figure 1:
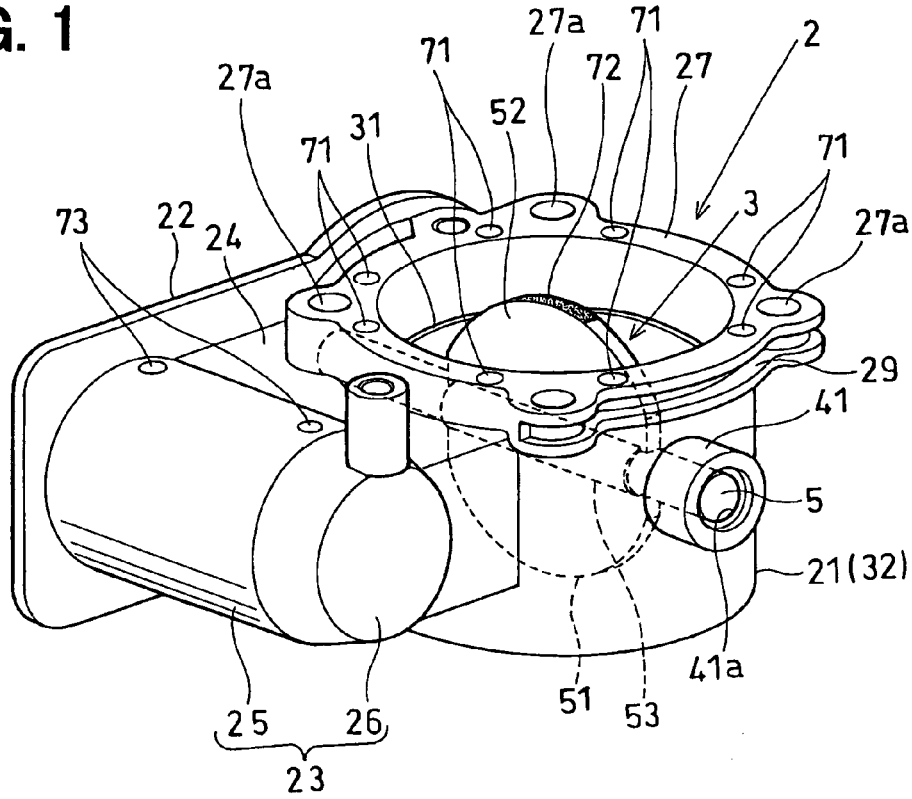
FIG. 1 is a perspective view of a throttle valve and a throttle body showing mark of ejector pins according to a first embodiment of the present invention.

An embodiment of the present invention will be described hereinafter with reference to the drawings.

First Embodiment

As shown in FIGS. 1 to 6, a throttle control apparatus has a driving motor 1, a throttle body 2, a throttle valve 3, a coil spring 4, and an electronic control unit which is referred to as ECU hereinafter. The driving motor 1 functions as a power source. The throttle body 2 forms a part of intake passage communicated with each cylinder of an internal combustion engine. The throttle valve 3 controls an amount of intake air flowing into the engine through the throttle body 2. The coil spring 4 urges the throttle valve 3 in the close direction. The ECU electrically controls the opening degree of the throttle valve 3 according to an operation degree (accelerator operation amount) of an accelerator pedal stepped by a driver.

The ECU is electrically connected with an accelerator position sensor (not shown) which converts the accelerator operation amount into an accelerator position signal. The accelerator position signal represents the accelerator operation amount. The electrically controlled throttle apparatus has a throttle position sensor that converts an opening degree of the throttle valve 3 into an electronic signal (throttle position signal) in order to output the throttle position signal to the ECU. The throttle position signal represents an opening degree of the throttle valve 3. The ECU performs PID (proportional, integral and differential [derivative]) feedback control with respect to the driving motor 1 in order to eliminate deviation between the throttle position signal transmitted from the throttle position sensor and the accelerator position signal transmitted from the accelerator position sensor.

The throttle position sensor is constructed with permanent magnets 6, yokes (not shown), a hall element (not shown), a terminal (not shown), a stator (not shown) and the like. The permanent magnets 6 are separated rectangular magnets used for generating a magnetic field. The yokes are constructed with separated substantially arc-shaped pieces, and are magnetized by the permanent magnets 6. The hall element is integrally provided with a sensor cover 7 to be opposed to the separated permanent magnets 6. The stator is made of a ferrous metallic material for concentrating magnetic flux into the hall element. The separated permanent magnets 6 and the separated yokes are secured to the inner periphery of a valve gear 8, which constructs the reduction gears, using glue or the like.

The sensor cover 7 is formed of a resinous material such as thermo plastic in a predetermined shape, in order to electrically insulate between terminals of the throttle position sensor and power-supply terminals of the driving motor 1. The sensor cover 7 has an engaging part that engages with a corresponding engaged part, which is formed on the opening side of the gearbox part 22 of the throttle body 2, each other. The engaging part of the sensor cover 7 and the engaged part of the gearbox part 22 are connected using a rivet, a screw (not shown), or are thermally swaged with each other. A cylindrical shaped receptacle 7*a* is integrally molded with the sensor cover 7 to be connected with an electrical connector (not shown).

A driving unit rotating the throttle valve 3 in the opening or closing direction includes the driving motor 1, a reduction gear and a reduction gear which transmits the driving force of the driving motor 1 to the throttle valve 3 through a metal shaft 5. The driving motor 1 is connected with terminals which is provided in the sensor cover 7. The driving motor 1 is fixed on the throttle body 2 with a screw 9.

The reduction gears reduce rotation speed of the driving motor 1 by a predetermined reduction gear ratio. The reduction gears (valve driving means, power transmission unit) is constructed with a pinion gear 11, a middle reduction gear 12 and the valve gear 8 for driving the metal shaft 5 that rotates the throttle valve 3. The pinion gear 11 is secured to the outer periphery of the motor shaft of the driving motor 1. The middle reduction gear 12 engages with the pinion gear 11 to be rotated by the pinion gear 11. The valve gear 8 engages with the middle reduction gear 12 to be rotated by the middle reduction gear 12.

The pinion gear 11 is made of a metallic material, and is integrally formed with the motor shaft of the driving motor 1 to be in a predetermined shape, so that the pinion gear 11 serves as a motor gear that integrally rotates with the motor shaft of the driving motor 1. The middle reduction gear 12 is formed to be in a predetermined shape of a resinous material, and is rotatably provided onto the outer periphery of the supporting shaft 14 that serves as a rotation center of the middle reduction gear 12. The middle reduction gear 12 is constructed with a large gear part 15, which engages with the pinion gear 11 of the motor shaft, and a small gear part 16 that engages with the valve gear 13. The supporting shaft 14 is integrally molded with the bottom wall of the gearbox part 22 of the throttle body 2. An end part of the supporting shaft 14 engages with a recess portion formed in the inner wall of the sensor cover 7.

The valve gear 8 is integrally molded to be in a predetermined substantially cylindrical shape of a resinous material. Gear teeth (teeth part) 17 are integrally formed in the outer periphery of the valve gear 8 to engage with the small gear part 16 of the middle reduction gear 12. The outer periphery of the cylindrical part (spring inner periphery guide) of the valve gear 8 supports the diametrically inner periphery of the coil spring 4. A full-close stopper portion 19 is integrally formed with the valve gear 8 on one end plane in the outer circumferential periphery of the valve gear 8, i.e., the gear teeth 17. The full-close stopper portion 19 hooks to the full-close stopper 13 of the gearbox part 22, when the throttle valve 3 is in the idling position, i.e., full close position.

The throttle body 2 is a throttle housing that includes the substantially cylindrical-shaped bore wall part 21 internally forming a circular-shaped intake passage, through which intake air flows into the engine. The bore wall part 21 internally receives the disc-shaped throttle valve 3, such that the throttle valve 3 can open and close the circular-shaped intake passage of the bore wall part 21. The bore wall part 21 rotatably receives the throttle valve 3 in the intake passage (bore), such that the throttle valve 3 can rotate from the full close position to the full open position. The throttle body 2 is screwed onto an intake manifold of the engine using a fasting bolt or a screw (not shown).

The bore wall part 21 of the throttle body 2 is formed in a predetermined shape that has a double-pipe structure, in which a substantially cylindrical-shaped bore outer pipe 32 is arranged on the diametrically outer side of a substantially cylindrical-shaped bore inner pipe 31. The bore inner pipe 31 is an internal side cylindrical part that forms an internal periphery. The bore outer pipe 32 is an external side cylindrical part that forms an outer member. The bore wall part 21 of the throttle body 2 is made of a thermo stable resinous material, such as PPS, PA, PP or PEI. The bore inner pipe 31 and the bore outer pipe 32 have an intake-air inlet part (air intake passage) and an intake-air outlet part (air intake passage). Intake air drawn from an air cleaner (not shown) passes through an intake pipe (not shown), the intake-air inlet part and the intake-air outlet part of the bore wall part 21. Subsequently, the intake air flows into a surge tank of the engine or the intake manifold. The bore inner pipe 31 and the bore outer pipe 32 are integrally molded with each other. The bore inner pipe 31 and the bore outer pipe 32 have a substantially the same inner diameter and a substantially the same outer diameter along with the intake airflow direction, i.e., the direction from the upper side to the lower side in the vertical direction of FIG. 1.

The bore inner pipe 31 internally has an air intake passage, through which intake air flows to the engine. The throttle valve 3 and the metal shaft 5 are rotatably provided in the air intake passage of the bore inner pipe 31. A cylindrical space (annular space) is formed between the bore inner pipe 31 and the bore outer pipe 32, and the cylindrical space is circumferentially blocked, i.e., partitioned, by an annular connecting part 33 at a substantially longitudinally central section thereof. For instance, the substantially longitudinally central section of the cylindrical space is a section along with a circumferential direction of the throttle valve 1 in the full close position. Namely, the substantially longitudinally central section is a circumferential section of the bore wall part 21 passing through the axial center of the throttle shaft. The annular connecting part 33 connects the outer periphery of the bore inner pipe 31 and the inner periphery of the bore outer pipe 32, such that the annular connecting part 33 blocks substantially entirely over the circumferential area of the cylindrical space formed between the bore inner pipe 31 and the bore outer pipe 32.

The cylindrical space between the bore inner pipe 31 and the bore outer pipe 32 located on the axially upstream side with respect to the annular connecting part 33 serves as a blockade recess part (moisture trapping groove) 34 for blocking moisture flowing along with the inner periphery of the intake pipe toward the intake manifold. The cylindrical space between the bore inner pipe 31 and the bore outer pipe 32 located on the axially downstream side with respect to the annular connecting part 33 serves as a blockade recess part (moisture trapping groove) 35 for blocking moisture flowing along with the inner periphery of the intake manifold.

The motor housing part 23, which receives the driving motor 1, is integrally molded of the resinous material with the bore wall part 21 via connecting portion 24 to construct the throttle body 2. The motor housing part 23 is arranged in parallel with the bore wall part 21. That is, the motor housing part 23 is in parallel with the bore wall part 21 with respect to the gearbox part 22 in the throttle body 2. The motor housing part 23 is arranged on the radially outer side of the bore outer pipe 32. The motor housing part 23 is integrally molded of the resinous material with the gearbox part 7. Specifically, the motor housing part 23 is integrally molded with the end face of the gearbox part 22 located on the left side in FIG. 1. The gearbox part 22 has a chamber for rotatably receiving the reduction gears. The motor housing part 23 has a substantially cylindrical sidewall part 25 and a substantially circular shaped bottom wall part 26. The sidewall part 25 extends from the left side face of the gearbox part 22 in the left direction in FIG. 1. The bottom wall part 26 plugs the opening side of the sidewall part 41 on the left side in FIG. 1. The central axis of the sidewall part 25 of the motor housing part 23 is arranged substantially in parallel with the axis of the metal shaft 5, i.e., rotation axis of the throttle valve 3. Besides, the central axis of the sidewall part 25 of the motor housing part 23 is arranged substantially perpendicularly to the central axis of the bore inner pipe 31 of the bore wall part 21.

The bore outer pipe 32 has a stay 27 at the opening end thereof. The stay 27 is a ring shaped portion which is integrally formed and is radially extending from the bore outer pipe 32*a*. The stay 27 is for fixing the throttle apparatus on the intake manifold and has a plurality of through hole 27*a* through which bolts are inserted. The stay 27 has an undercut portion 29 which communicates with some of the through hole 27*a*.

Referring to FIG. 1, the bore inner pipe 31 and the bore outer pipe 32 has the substantially cylindrical first valve bearing 41 and the substantially cylindrical second valve bearing (not shown) that are integrally molded of a resinous material. The first valve bearing 41 rotatably supports the first bearing sliding part of the metal shaft 5. The second valve bearing rotatably supports the second bearing sliding part of the metal shaft 5. A circular-shaped first shaft hole 41*a* is formed in the first valve bearing 41, and a circular-shaped second shaft hole (not shown) is formed in the second valve bearing. A plug (not shown) is provided on the first valve bearing 41 for plugging the opening side of the first valve bearing 41. The second valve bearing is integrally molded with the bore wall part 216, i.e., bottom wall of the gearbox part 22 of the throttle body 2, to be protruded in the right direction in FIG. 2. The outer periphery of the second valve bearing serves as a spring inner periphery guide (not shown) for supporting the diametrically inner periphery of the coil spring 4. A stay part 45 is integrally molded of the resinous material on the outer periphery, i.e., outer wall 6*a* of the bore outer pipe 32. The stay part 45 is connected with a connecting end face of the intake manifold of the engine 80 using a fastening member such as a bolt (not shown), when the throttle body 5 is mounted on the engine 80. The stay part 45 is provided on the outer wall 6*a* of the bore outer pipe 32 located on the lower end side in FIG. 1.

The coil spring 4 is provided on the outer peripheral side of the metal shaft 5. One end part of the coil spring 4 is supported by a body side hook (not shown) provided on the outer wall of the bore wall part 21, i.e., bottom wall of the gearbox part 22. The other end part of the coil spring 4 is supported by a gear side hook (not shown) provided on a plane of the valve gear 8 that is located on the side of the bore wall part 21.

The throttle valve 3 is a butterfly valve of which axis is substantially orthogonal to the center axis of the bore wall part 21. The opening position of the throttle valve is varied from a full-opening position to a full-closing position to control the air amount which is introduced into the engine. The throttle valve 3 is comprised of a first semicircle plate 51, a second semicircle plate 52, a cylindrical resin shaft 53, and the metal shaft 5. The first and the second semicircle plates 51, 52 are made of a thermoplastic synthetic resin, such as PPS, PA, PP, and PEI. When the first and the second semicircle plates 51, 52 are fixed on the cylindrical resin shaft 53, the first and the second semicircle plates 51, 52 form a resin disc.

When the throttle valve 3 is in the full-opening position, the first semicircle plate 51 is positioned upper side of the bore wall part 21 and the second semicircle plate 52 is positioned lower side of the bore wall part 21 with respect to the resin shaft 53. The first and the second semicircle plate 52 are provided with stiffening ribs on the one side or both sides thereof. The resin shaft 53 is integrally molded with the metal shaft 5, by which the throttle valve 3 and the metal shaft 5 are integrated to rotate together.

The metal shaft 5 is a throttle shaft made of a metallic material such as brass or stainless steel to be in a round-bar shape. The axis of the metal shaft 5 is arranged to be in a direction substantially perpendicular to a central axis of the bore wall part 21 of the throttle body 2, and is arranged to be in a direction substantially parallel to the central axis of a motor housing part 23. In this embodiment, the metal shaft 5 has a valve supporting portion for supporting the resinous shaft 53. The metallic valve supporting portion is insert molded inside of the resin shaft part 53 to reinforce the first and the second semicircle plates 51, 52 and the resin shaft 53. In this embodiment, the metal shaft 5 is used as the throttle shaft. The throttle shaft can be molded of resin material with the resin shaft 53 to reduce the number of parts.

Figure 2:
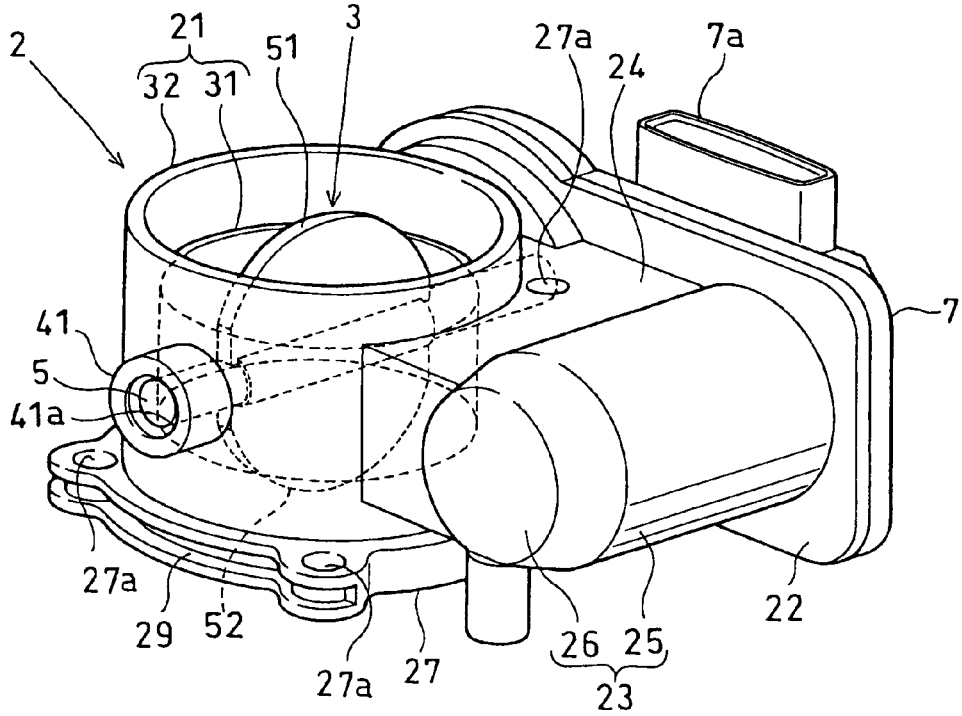
FIG. 2 is a perspective view of a throttle control apparatus according to the first embodiment.
Figure 3:
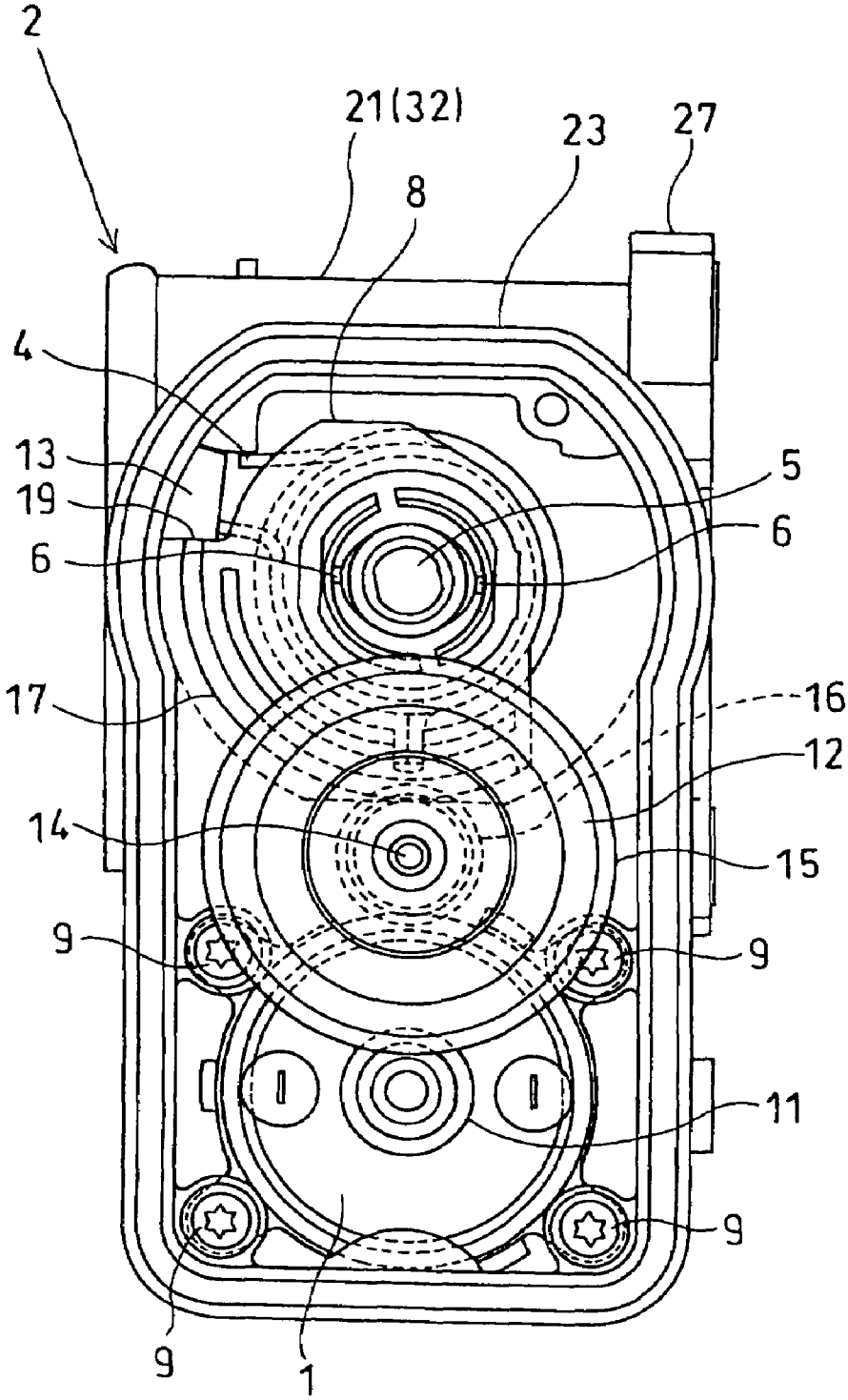
FIG. 3 is a front view showing an inside of a gearbox according to the first embodiment.
Figure 4:
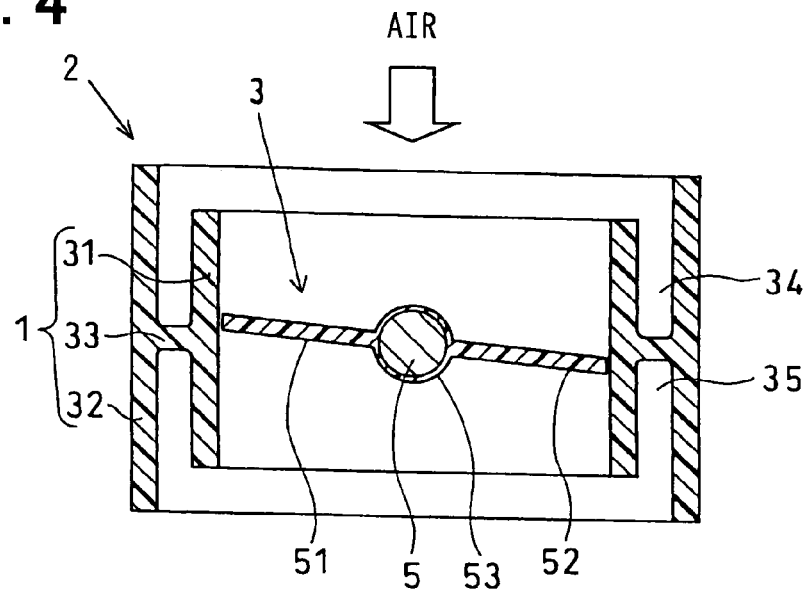
FIG. 4 is a cross sectional view of a double-piped bore wall according to the first embodiment.

One end portion of the metal shaft 2 on the left side end in FIG. 2 exposes (protrudes) from one end face of the resin shaft 53 in order to serve as a first bearing sliding part that rotatably slides with respect to the first valve bearing 41. The other end side of the throttle shaft on the right side end in FIG. 2 exposes (protrudes) from the other end face of the resin shaft 53 in order to serve as a second bearing sliding part (not shown) that rotatably slides with respect to a second valve bearing (not shown) of the bore wall part 21. The valve gear 8 constructing the reduction gears is integrally provided on the other end portion of the metal shaft 5 on the right side end in FIG. 2.

Figure 5:
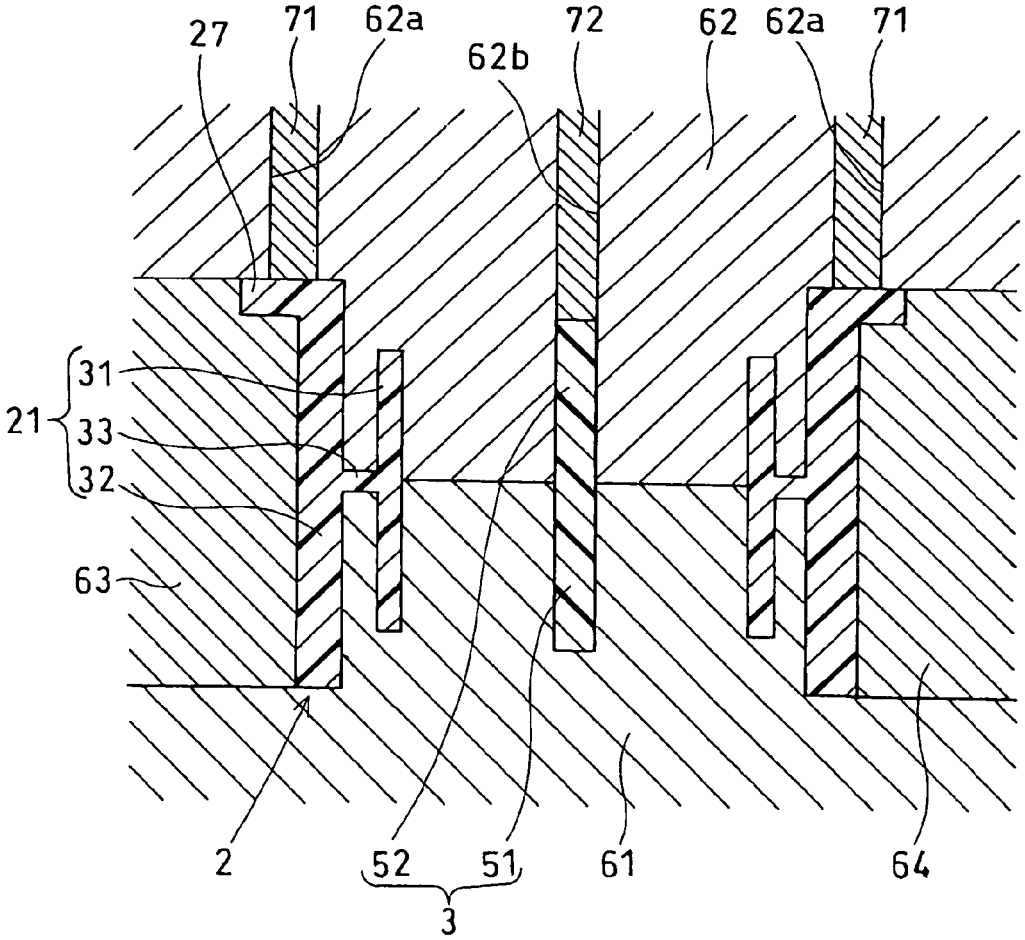
FIG. 5 is across sectional view of a resin molding dies according to the first embodiment.
Figure 6:
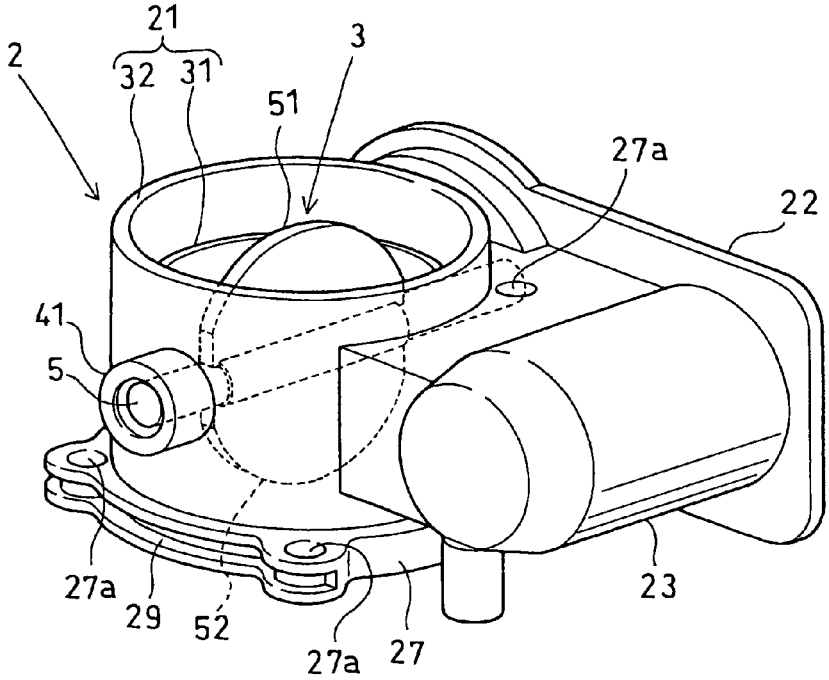
FIG. 6 is a perspective view of the resin molding goods according to the first embodiment.

Referring to FIGS. 1 to 6, the forming method of the throttle apparatus is described hereinafter. FIG. 5 schematically shows molding dies and FIG. 6 shows a molded product of the throttle apparatus.

As shown in FIG. 5, the molding dies include a fixed die 61 and a movable die 62 which can move forward and backward relative to the fixed die 61. In FIG. 5, the movable die 62 moves up and down relative to the fixed die 61. A parting line of the dies 61, 62 is positioned on the axis of the throttle valve 3 in order to form the inner surface of the bore inner pipe 31 and the throttle valve 3. The movable die 62 includes slide cores 63, 64 which can slide transversely in FIG. 5, and includes a slide core (not shown) in order to form the undercut portion 29.

When the molding dies are closed, the fixed die 61, the movable die 62, and slide cores 63, 64 form a body cavity, a valve cavity, and a housing cavity. The body cavity corresponds to the shape of the bore wall part 21. The valve cavity corresponds to the shape of the first and the second plate 51, 52 and the resin shaft 53. The housing cavity corresponds to the shape of the motor housing 23 and the connecting portion 24. The body cavity includes a first body cavity to form the bore wall part 21 and a second body cavity to form the gearbox part 22. The valve cavity includes a first valve cavity to form the first semicircle plate 51, and a second valve cavity to form the second semicircle plate 52.

The body cavity, the valve cavity, and the housing cavity are connected with a resin material supplying apparatus (not shown). The resin material supplying apparatus includes single or multiple body gates through which a melted resin such as PPS and PBT is injected into the body cavity and the housing cavity, and single or multiple valve gates through which a melted resin such as PPS and PBT is injected into the valve cavity. The body cavity and the housing cavity are communicated with each other. The valve cavity is isolated from the body cavity by the fixed die 61 and the movable die 62.

The resin material supplying apparatus includes an ejector mechanism which removes a resin mold from the molding die when the movable die 62 moves away from the fixed die 61. The ejector mechanism includes multiple ejector pins, a movable ejector plate (not shown), and a power unit, such as an oil pressure cylinder and an air pressure cylinder. The multiple ejector pins are connected with the movable ejector plate. The power unit pushes the movable ejector plate in such a manner that the ejector pins are pushed into the cavities to removes the resin mold from the die.

The ejector pins are comprised of body ejector pins 71, one valve ejector pin 72, and motor housing ejector pins 73. The body ejector pins 71 can protrude into the body cavity, the valve ejector pin 72 can protrudes into the valve cavity, and the motor housing ejector pins 73 can protrude into the housing cavity. Eight body ejector pins are slidably supported in the ejector holes 62*a* which are provided in the movable die 62, and are located at predetermined intervals according to the shape of the stay 27. The tip end of the body ejector pin 71 is rounded and can push the stay 27.

The valve ejector pin 72 is a flat plate which is slidably supported in an ejector hole 62*b* disposed in the movable die 62. A tip end of the valve ejector pin 72 is concaved to push the outer periphery surface of the second semicircle plate 52.

Multiple motor housing ejector pins 73, which are two pins in this embodiment, are slidably supported in the ejector holes (not shown) which are provided in the movable die 62, and are located at predetermined intervals on a line according to the shape of the motor housing 73. The tip end of the housing ejector pin 73 is rounded and can push the motor housing 23.

In order to form the throttle valve 3 and the throttle body 2 simultaneously in the same die, the valve cavity is formed in such a manner that the molded throttle valve 3 is positioned in the full-opening position.

The movable die 62 is moved toward the fixed die 61 to be clamped each other. The body cavity, the valve cavity, and the housing cavity are formed between the movable die 62 and the fixed die 61. The metal shaft 5 is rotatably supported by the first bearing 41. The center portion of the metal shaft 5 supports the resin shaft 53. The metal shaft 5 is insert molded in the resin shaft 53. Both ends of the metal shaft 5 are supported by the fixed die 61 and the movable die 62.

The melted resin is injected into the body cavity, the valve cavity, and the housing cavity through the body gates and the valve gates. Each of the cavities is filled with the melted resin. At this moment, both ends of the metal shaft 5 are supported by the first and the second holding portion of the molding dies.

The inner pressures of the cavities are increased, and the holding pressure which is higher than the maximum pressure of the injection pressure is maintained. The body gate can confront any surface of the bore inner pipe 31 or the surface of the motor housing 23. The valve gate can confront the surface of the semicircle plates 51, 52 or the surface of the resin shaft 53.

The injected resin in the cavities is cooled by a cooling water to be solidified. The cooling water circulates in the dies. The movable die 62 and the slide cores 63, 64 are moved backward from the fixed die 61. The slide cores 63, 64 are moved away from the movable die 62. The slide core forming the undercut portion 29 is moved in the axial direction of the bore outer pipe 32 along the outer surface of the bore outer pipe 32. The solidified resin mold is kept to be attached to the surface of the movable core 62 at this stage.

The ejector mechanism drives the ejector plate in order to remove the resin product from the movable die 62. The body ejector pins 71, a valve ejector pin 72 and the motor housing pins 73 slide in the through holes 62*a*, 62*b* to protrude into the body cavity, valve cavity and the housing cavity. Consequently, the resin product is pushed out to be released from the movable die 62. Thereby, the throttle apparatus shown in FIG. 6, which has throttle body 2 and throttle valve 3 is produced. The metal shaft 5 is insert molded in the resin shaft 53.

As follows, an operation of the electrically controlled throttle apparatus is described. When the driver steps the accelerator pedal of the vehicle, the accelerator position signal, which is transmitted from the accelerator position sensor to the ECU, changes. The ECU controls electric power supplied to the driving motor 1, so that the motor shaft of the driving motor 1 is rotated and the throttle valve 1 is operated to be in a predetermined position. The torque of the driving motor 1 is transmitted to the valve gear 8 via the pinion gear 11 and the middle reduction gear 12. Thus, the valve gear 8 rotates by a rotation angle corresponding to the stepping degree of the accelerator pedal, against urging force generated by the coil spring 4.

Therefore, the valve gear 8 rotates, and the metal shaft 5 also rotates by the same angle as the rotation angle of the valve gear 8, so that the throttle valve 3 rotates from its full close position toward its full open position. As a result, the air intake passage formed in the bore inner pipe 31 of the bore wall part 21 of the throttle body 2 is opened by a predetermined degree, so that rotation speed of the engine is changed to be a rotation speed corresponding to the stepping degree of the accelerator pedal by the driver.

When the driver releases the accelerator pedal, the throttle valve 3, the metal shaft 5, and the valve gear 8 return to an initial position of the throttle valve 3 by urging force of the coil spring 4. The initial position of the throttle valve 3 is an idling position or the full close position. When the driver releases the accelerator pedal, the value of the accelerator position signal transmitted by the accelerator position sensor becomes substantially 0%. Therefore, in this situation, the ECU can supply electric power to the driving motor 1 in order to rotate the motor shaft of the driving motor 1 in its reverse direction, so that the throttle valve 3 is controlled at its full close position. In this case, the throttle valve 3 can be rotated in the close direction by the driving motor 1.

The throttle valve 3 rotates in the close direction by urging force of the coil spring 4 until the full-close stopper portion 19 provided on the valve gear 8 contacts the full-close stopper 13 integrally molded on the inner wall of the gearbox part 22 of the throttle body 2. Here, the close direction is a direction, in which the throttle valve 3 closes the air intake passage by rotating from the full open position to the full close position. Rotation of the throttle valve 3 is restricted by the full-close stopper 19 at the full close position of the throttle valve 3. Therefore, the throttle valve 3 is maintained in the predetermined full close position, i.e., idling position, in the air intake passage formed in the bore inner pipe 31. Thus, the air intake passage connected to the engine is substantially closed, so that rotation speed of the engine is set at a predetermined idling speed.

In the present embodiment, the throttle body 2 and the throttle valve 3 is integrally molded of the resin in such a manner that the throttle valve 3 is in full opened position in order that the throttle valve 3 can rotate in the bore inner pipe 31.

Figure 8:
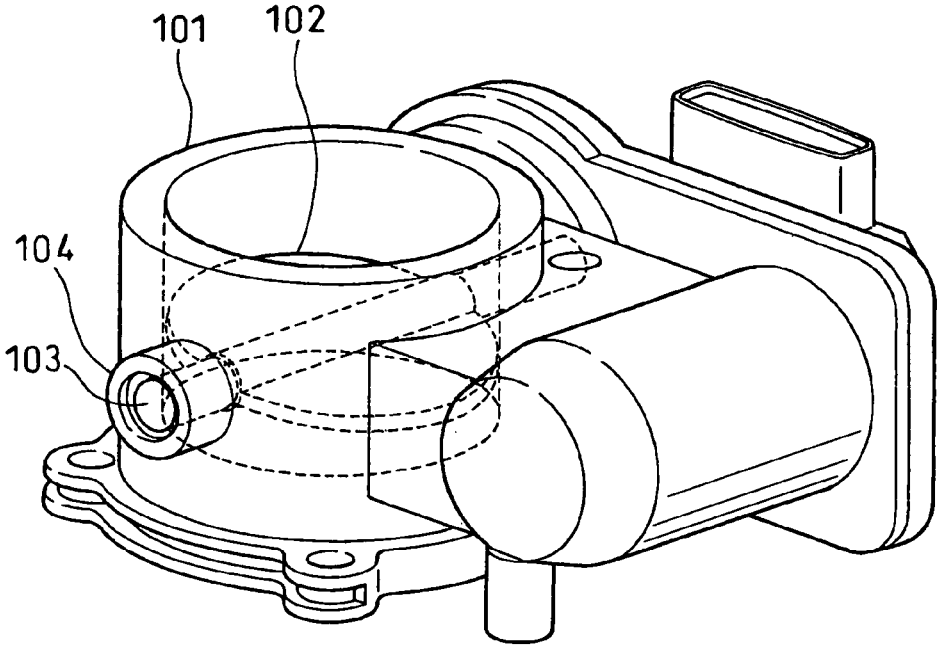
FIG. 8 PRIOR ART
FIG. 8 is a perspective view of a conventional throttle apparatus.
Figure 9:
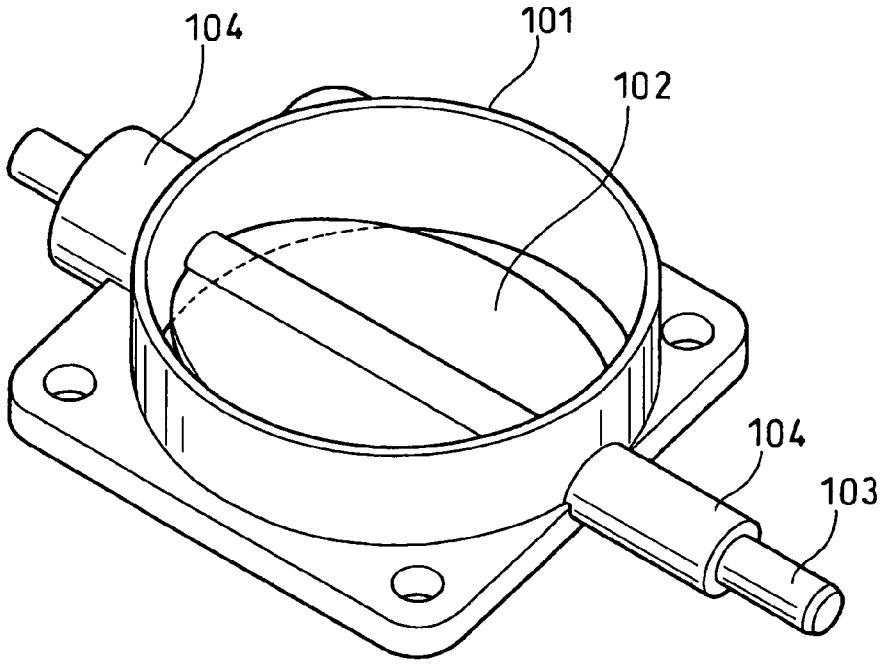
FIG. 9 PRIOR ART
FIG. 9 is a perspective view of a throttle valve for explaining a conventional method.
Figure 10:
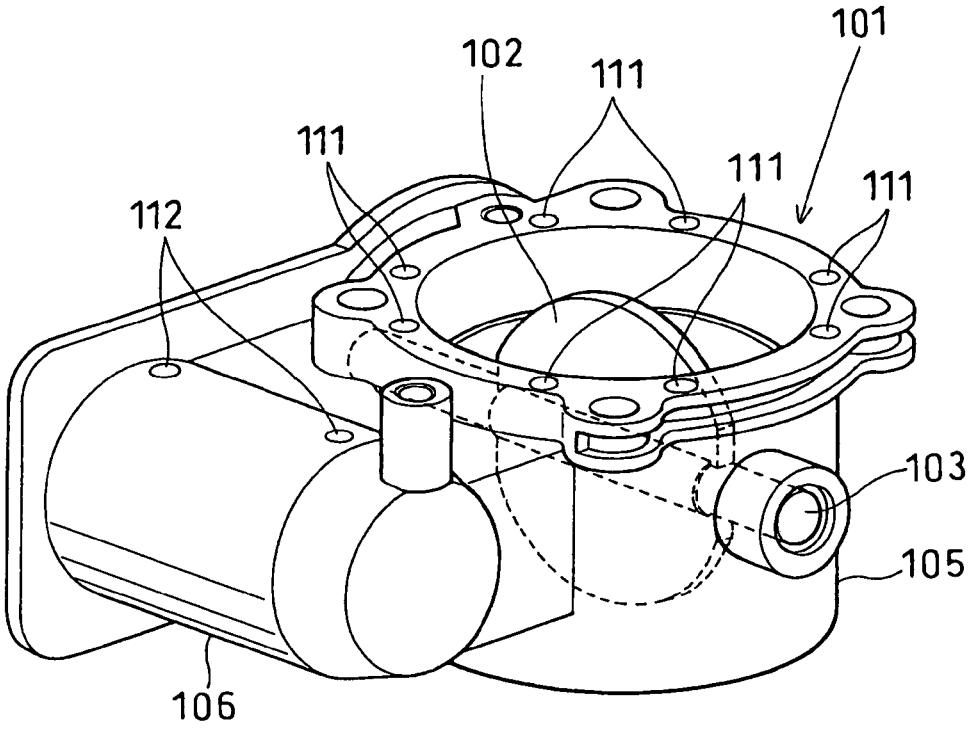
FIG. 10 is a perspective view of a perspective view of a throttle body according to a comparative example.

In the conventional molding dies for forming the throttle apparatus shown in FIG. 8, a thin cylindrical die is needed to form a gap between the throttle body 101 and the throttle valve 102, so that the cost of the dies and production cost are increased. However, in the present embodiment, the molding dies are needed to form the inner surface of the bore inner pipe 31 and both ends of the axis of the throttle valve 3. In other words, the inner surface of the bore inner pipe 31 at the vicinity of the first and the second bearings 41 is isolated from both ends of the axis of the throttle valve 2 by the first and the second shaft holding part of the fixed die 61 and the movable die 62, and both ends of the metal shaft 5. Therefore, the throttle valve 3 and the throttle body 2 are molded at the same time in the same dies without increasing production cost.

Furthermore, the inner surface of the bore inner pipe 31 and the both ends of metal shaft 5 are isolated from each other. The body cavity and the valve cavity are isolated enough to maintain the gap between the inner surface of the bore inner pipe 31 and the outer surface of the throttle valve 3 in a proper value, by which the product function is not deteriorated. That is, the throttle valve 3 can rotate in the bore inner pipe 31 without any interference there between. The throttle valve 3 and the metal shaft 5 are hardly stuck. When the throttle valve 3 is fully closed, the air tightness of the throttle valve 3 is not deteriorated.

When the moving die 62 moves away from the fixed die 61, the ejector pines 71, 72, 73 push an annular end of the bore wall part 21, the side surface of the motor housing 23, and the peripheral end of throttle valve 3. Thus, when the resin mold is pushed out by the ejector pines 71, 72, 73, an over stress is not applied to the resin shaft 53 and the metal shaft 5 to restrict deformation of the resin shaft 3 and the metal shaft 5. In FIG. 1, small circles indicated with the numeral 71, 72, 73 are attach marks to which the ejector pins 71, 72, 73 are attached.

In the modification of the present embodiment, each of the ejector pins 71, 72, 73 is sequentially actuated.

Second Embodiment

Figure 7A:
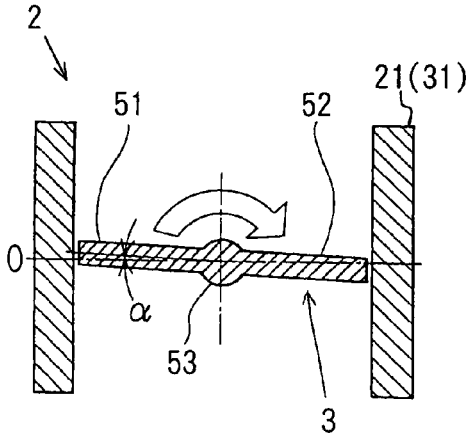
FIG. 7A and FIG. 7B are cross sectional view for explaining a method of resin injection molding.
Figure 7B:
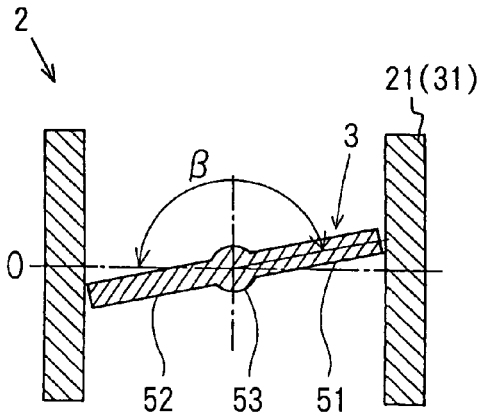

As shown in FIGS. 7A and 7B, the throttle valve 3 is molded of a resinous material in the same molding dies as that of the throttle body 2. In this situation, a rotation angle (valve forming angle $\theta$) of the throttle valve 3 is set between a rotation angle $\alpha$ ($\geqq 0°$) corresponding to the full close position of the throttle valve 3 and a rotation angle $\beta$ ($\leqq 180°$) corresponding to a position of the throttle valve 3, in which the throttle valve 1 contacts the throttle body 2. The relation among $\alpha$, $\beta$ and $\theta$ is shown by the following equation (1).

$$\alpha<\theta<\beta \tag{1}$$

According to the second embodiment, the fixed die 61 and movable die 62 can isolate the inner surface of the bore inner pipe 31 from the outer periphery of the throttle valve 3.

(Modification)

In the aforementioned embodiment, the throttle valve 3 is rotated by the driving motor 1. The present invention can be applied to a mechanical throttle apparatus in which the accelerator pedal is mechanically connected to the throttle valve 3 through a wire cable.

The valve holding part of the metal shaft 5 has a knurled portion in order to firmly connect the metal shaft 5 to the throttle valve 3. The metal shaft 5 and the resin shaft 53 can have width across flats to restrict relative rotation there between.

Before molding, mold release agent or lubricant, such as fluorine resin and molybdenum disulfide can be applied to both ends of the metal shaft 5.

In the aforementioned embodiment, the bore inner pipe 31 and the bore outer pipe 32 have the same center axis. The center axes of bore pipes 31,32 can be offset to each other.

The bore wall 21 can be single pipe construction.

The aforementioned embodiment includes a blockade recess parts (moisture trapping groove) 34, 35 for blocking moisture. Only blockade recess part 34 can be provided.

The throttle apparatus can include a bypass passage which bypasses the throttle valve 3, and further include an idle speed control valve in the bypass passage to control the amount of the air introduced into the engine. An outlet of a positive crankcase ventilation (PCV) device or a purge tube can be connected to the intake manifold upstream of the bore wall 21. In such an arrangement, the blockade recess part 34 blocks the oil mist and the deposit to restrict a defective operation of the throttle valve 3 and the metal shaft 5.

The gearbox part 22 can be molded of a resin material with the throttle body 2. Ejector pins (not shown) push the gearbox part 22 in the axis direction of the bore wall part 21.

In the first embodiment, the ejector pins 71, 72, 73 can push the molding from the opposite direction.

The bore wall part 21, the gearbox part 22, motor housing 23, the first and the second semicircle plates 51, 52, and the resin shaft 53 can be made of a thermoplastic resin including filling materials, such as PBTG30 (polybutylene terephthalate including grass fiber by 30%).

The throttle apparatus can be made of aluminum alloy or magnesium alloy.

What is claimed is:

1. A forming method of a throttle apparatus for an internal combustion engine, the throttle apparatus including a substantially tubular throttle body and a substantially disc-shaped throttle valve, the throttle valve having an axis around which the throttle valve rotate in the tubular throttle body between a close position and an open position, the throttle valve and the throttle body being molded substantially simultaneously in same molding dies in such a manner that the throttle valve is rotated by a predetermined angle with respect to a full closed position in which the throttle valve and the throttle body define a minimum gap therebetween, the forming method of the throttle apparatus, comprising:

clamping a pair of molding dies to form a body cavity and a valve cavity therein, the body cavity being for molding a throttle body and the valve cavity being for molding a throttle valve in such a manner that the throttle valve is rotated by a predetermined angle with respect to a full closed position, so that the throttle valve is not in contact with an inner bore surface of the throttle body;

substantially simultaneously injecting a filler into the body cavity and the valve cavity;

moving one of said molding dies away from the other of said molding dies; and protruding a body ejector into the body cavity and a valve ejector pin into the valve cavity in order to eject a solidified molding.

2. The forming method of a throttle apparatus according to claim 1, wherein the throttle body is made of a thermoplastic synthetic resin, an aluminum alloy, or a magnesium alloy, the throttle valve is made of the same material as the throttle body.

3. The forming method of a throttle apparatus according to claim 1, wherein the throttle body and the throttle valve are made from a resin material containing a filler.

4. The forming method of a throttle apparatus according to claim 1, wherein the molding dies are comprise of a fixed die and a movable die which form the body cavity and the valve cavity therein, the body ejector pin and the valve ejector pin are connected with an ejector plate which is slidably disposed behind the fixed die or the movable die, and a power unit moves the ejector plate in an ejecting direction of the ejector pins when the movable die moves away from the fixed die.

5. The forming method of a throttle apparatus according to claim 4, wherein the body ejector pin is slidably supported in a through hole which is provided in the fixed die or the movable die, one end of the body ejector pin is able to push an end of the throttle body in an axial direction, and the other end of the body ejector pin is connected with the ejector plate.

6. The forming method of a throttle apparatus according to claim 4, wherein the valve ejector pin is slidably supported in a through hole which is provided in the fixed die or the movable die, one end of the valve ejector pin is able to push an outer periphery of the throttle valve, and the other end of the valve ejector pin is connected with the ejector plate.

7. The forming method of a throttle apparatus according to claim 1, wherein the throttle valve is a butterfly valve of which rotational axis is substantially perpendicular to a center axis of the throttle body;

the throttle valve is molded under a condition in which the throttle valve is opened in a predetermined angle.

8. The forming method of a throttle apparatus according to claim 7, wherein the valve ejector pin pushes out the peripheral edge of the throttle valve in a radial direction thereof in order to eject a solidified molding from the valve cavity.

9. The forming method of a throttle apparatus according to claim 7, wherein the throttle body includes a cylindrical bore wall through which intake air is introduced into the internal combustion engine and includes an annular stay for fixing the throttle body on the internal combustion engine, the body ejector pin pushes out the annular stay to eject a solidified molding from the body cavity.

10. The forming method of a throttle apparatus according to claim 7, wherein the throttle body includes a cylindrical bore wall which is comprised of a bore inner pipe and a bore outer pipe, the body ejector pin pushes out an annular edge of the bore outer pipe to eject a solidified molding from the body cavity.

11. The forming method of a throttle apparatus according to claim 7, wherein the throttle body includes a cylindrical bore wall through which intake air is introduced into the internal combustion engine, and the body ejector pin pushes out an annular edge of the bore wall in order to eject a solidified molding from the body cavity.

12. The forming method of a throttle apparatus according to claim 11, wherein the throttle body includes a substantially cylindrical housing accommodating a driving motor, the housing being adjacent to the bore wall, and the molding dies forms a housing cavity of which shape corresponds to the housing, and further comprising an housing ejector pin capable of protruding into the housing cavity.

13. The forming method of a throttle apparatus according to claim 12, wherein the housing ejector pin pushes a side surface of the housing in order to eject a solidified molding from the housing cavity.

14. The forming method of a throttle apparatus according to claim 12, wherein the molding dies include a fixed die and a movable die which form the body cavity, the valve cavity, and the housing cavity therein, the body ejector pin, the valve ejector pin and the housing ejector pin are slidably moved by a power unit in order to eject the molding.

15. The forming method of a throttle apparatus according to claim 14, wherein the body ejector pin is slidably supported in a through hole which is formed in the fixed die or the movable die, one end of the body ejector pin is in contact with an annular edge of the throttle body, and the other end of the body ejector pin is connected with the power unit.

16. The forming method of a throttle apparatus according to claim 14, wherein the valve ejector pin is slidably supported in a through hole which is formed in the fixed die or the movable die, one end of the valve ejector pin is in contact with a peripheral edge of the throttle valve, and the other end of the valve ejector pin is connected with the power unit.

17. The forming method of a throttle apparatus according to claim 14, wherein the housing ejector pin is slidably supported in a through hole which is formed in the fixed die or the movable die, one end of the housing ejector pin is in contact with a side surface of the housing, and the other end of the valve ejector pin is connected with the power unit.

18. A forming method of a throttle apparatus for an internal combustion engine, the throttle apparatus including a substantially tubular throttle body and a substantially disc-shaped throttle valve, the throttle valve being able to rotate in the tubular throttle body between a close position and a open position, the throttle valve and the throttle body being molded substantially simultaneously in same molding dies, the forming method of the throttle apparatus, comprising:

clamping molding dies to form a body cavity and a valve cavity therein, the body cavity being for molding a throttle body and the valve cavity being for molding a throttle valve;

injecting a filler into the body cavity and the valve cavity;

moving one of said molding dies away from the other of said dies; and protruding a body ejector pin into the body cavity and a valve ejector pin into the valve cavity in order to eject a solidified molding, wherein the throttle valve is a butterfly valve of which rotational axis is substantially perpendicular to a center axis of the throttle body, the throttle valve is molded under a condition in which the throttle valve is opened in a predetermined angle, and the valve ejector pin pushes out the peripheral edge of the throttle valve in a radial direction thereof in order to eject a solidified molding from the valve cavity.

19. A forming method of a throttle apparatus for an internal combustion engine, the throttle apparatus including a substantially tubular throttle body and a substantially disc-shaped throttle valve, the throttle valve being able to rotate in the tubular throttle body between a close position and a open position, the throttle valve and the throttle body being molded substantially simultaneously in same molding dies, the forming method of the throttle apparatus, comprising:

clamping molding dies to form a body cavity and a valve cavity therein, the body cavity being for molding a throttle body and the valve cavity being for molding a throttle valve;

injecting a filler into the body cavity and the valve cavity;

moving one of said molding dies away from the other of said dies; and protruding a body ejector pin into the body cavity and a valve ejector pin into the valve cavity in order to eject a solidified molding, wherein the throttle valve is a butterfly valve of which rotational axis is substantially perpendicular to a center axis of the throttle body, the throttle valve is molded under a condition in which the throttle valve is opened in a predetermined angle, the throttle body includes a cylindrical bore wall through which intake air is introduced into the internal combustion engine, and the body ejector pin push out an annular edge of the bore wall in order to eject a solidified molding from the body cavity.

20. A forming method of a throttle apparatus for an internal combustion engine, the throttle apparatus including a substantially tubular throttle body and a substantially disc-shaped throttle valve, the throttle valve being able to rotate in the tubular throttle body between a close position and a open position, the throttle valve and the throttle body being molded substantially simultaneously in same molding dies, the forming method of the throttle apparatus, comprising:

clamping molding dies to form a body cavity and a valve cavity therein, the body cavity being for molding a throttle body and the valve cavity being for molding a throttle valve;

injecting a filler into the body cavity and the valve cavity;

moving one of said molding dies away from the other of said dies; and protruding a body ejector pin into the body cavity and a valve ejector pin into the valve cavity in order to eject a solidified molding, wherein the throttle valve is a butterfly valve of which rotational axis is substantially perpendicular to a center axis of the throttle body, the throttle valve is molded under a condition in which the throttle valve is opened in a predetermined angle, the throttle body includes a cylindrical bore wall which is comprised of a bore inner pipe and a bore outer pipe, and the body ejector pin pushes out an annular edge of the bore outer pipe to eject a solidified molding from the body cavity.

* * * * *